US008105473B2

(12) United States Patent
Franz

(10) Patent No.: US 8,105,473 B2
(45) Date of Patent: Jan. 31, 2012

(54) PRODUCTION OF SATIN METAL SURFACES

(76) Inventor: Wolf-Dieter Franz, Geretsried (DE)

( * ) Notice: Subject to any disclaimer, the term of this patent is extended or adjusted under 35 U.S.C. 154(b) by 545 days.

(21) Appl. No.: 12/083,843

(22) PCT Filed: Oct. 20, 2006

(86) PCT No.: PCT/EP2006/067618

§ 371 (c)(1),
(2), (4) Date: Mar. 25, 2009

(87) PCT Pub. No.: WO2007/045688

PCT Pub. Date: Apr. 26, 2007

(65) Prior Publication Data

US 2009/0211913 A1 Aug. 27, 2009

(30) Foreign Application Priority Data

Oct. 20, 2005 (EP) ..... 05109770

(51) Int. Cl.
*C25D 5/12* (2006.01)

(52) U.S. Cl. ..... 205/181

(58) Field of Classification Search ..... 427/299, 427/404; 205/181, 205
See application file for complete search history.

(56) References Cited

U.S. PATENT DOCUMENTS

| | | | | |
|---|---|---|---|---|
| 926,800 | A * | 7/1909 | Young | 74/608 |
| 3,090,733 | A * | 5/1963 | Brown | 428/639 |
| 3,152,971 | A | 10/1964 | Tomaszewski et al. | |
| 3,449,223 | A | 6/1969 | Odekerken | |
| 3,644,183 | A | 2/1972 | Odekerken | |
| 2006/0266444 | A1 | 11/2006 | Kosslers et al. | |

FOREIGN PATENT DOCUMENTS

| | | | |
|---|---|---|---|
| GB | 1 074 389 | | 7/1967 |
| GB | 1 515 361 | A | 6/1978 |
| WO | WO 2004081263 | A1 * | 9/2004 |
| WO | WO 2004/090198 | A | 10/2004 |

OTHER PUBLICATIONS

Lowenheim, "Electroplating", © no month, 1978, pp. 218-219.*

International Preliminary Report on Patentability papers comprising one sheet Form PCT/IB/338, one sheet Form PCT/IB/373, and five sheets of Form PCT/ISA/237, for the International Application PCT/EP2006/067618 of which the above-captioned, instant patent application is a national stage.

English language Search Report for PCT/EP2006/067618 (3 pages) with German language cover sheet (1 page).

German language Form PCT/ISA/237 cover sheets (3 pages) and Supplement (3 pages) for PCT/EP2006/067618, and English language translation of the relevant parts of the Supplement.

Summary of the EP proceedings (EP 05 109 770.7) (1 page).

* cited by examiner

*Primary Examiner* — Edna Wong
(74) *Attorney, Agent, or Firm* — Wood, Phillips, Katz, Clark & Mortimer

(57) ABSTRACT

The invention relates to a galvanic metal coating with an adjustable satin gloss in which a matte Ni layer is deposited on a brilliant surface and is coated with a sulfamate Ni layer.

8 Claims, 1 Drawing Sheet

PRODUCTION OF SATIN METAL SURFACES

This application is an application filed under 35 U.S.C. Sec. 371 as a national stage of international application PCT/EP2006/067618, which was filed Oct. 20, 2006.

TECHNICAL FIELD

The present invention relates to the production of satin surfaces of workpieces, especially automobile parts.

BACKGROUND OF THE INVENTION

It is known to produce metal surfaces on various workpieces by galvanic processes. Both brilliant surfaces as well as matt surfaces are feasible.

For certain applications, especially for decoration surfaces in the automotive field, satin metal surfaces are of interest. During a galvanic production of said surfaces, the problem appears, to adjust the degree of matt finish and brilliant finish, respectively, and thus the precise degree of the compromise between brilliant and matt finish desired in satin surfaces, in a reproducible manner.

Further, galvanic methods are known in which galvanic Ni layers are made with an adjustable degree of satin finish by an additional organic additive to the galvanic solution, said additive precipitating on the surface in a droplet manner and impairing the surface structure. Therein, the degree of matte finish or satin finish must be adjusted de novo by the added amounts before starting a process in a relatively cumbersome manner and the organic additives must be filtered out in case of an interruption of the process or before a new process start in order not to impair the new process. Thus, the above-mentioned adjustment must be done with each new process start and thus is complicated and disadvantageous in view of the reproducibility.

Further, it is known to sand-blast Cu-covered surfaces and then deposit galvanic Ni. The satin finish cannot be adjusted in an appropriate manner herein. Further, flaws of the optical appearance due to the sand-blast process can easily be created, e.g. brilliant regions due to particles lying on the workpiece during the sand-blast process. Also other surface defects appear relatively clearly.

BRIEF SUMMARY OF THE INVENTION

The object of the invention is to provide an alternative method for producing satin metal surfaces on workpieces.

Hereto, the invention provides a method, having the steps: producing a smooth surface on a workpiece, depositing a matte Ni layer by galvanic deposition without organic matting additives, depositing a sulfamate Ni layer.

Preferred embodiments are claimed in the dependent claims and will be explained below.

A basic idea of the invention is to deposit a matte Ni layer on a smooth workpiece surface and to adjust the degree of matte finish by means of the thickness of the Ni layer. Herein, the invention is directed to galvanic Ni layers in and for which no organic matting additives have been used. Namely, in a preferred embodiment of the invention, a Watt Ni layer, known per se, can be used, which is technically simple and easy to control.

Then a further sulfamate Ni layer shall be deposited on this matte Ni layer. According to the invention, this has the advantage and function to make the more or less granular like structure of the matte Ni layer somewhat rounder and thus less rough and less sensitive to contaminations.

In total, the cooperation of the smooth surface on the workpiece appearing in some degree of residual brilliance depending on the thickness of the matte Ni layer, with the matte finish produced by the matte Ni layer, and finally with the above-mentioned rounded form due to the sulfamate Ni layer, produces an optically attractive and notably well reproducible satin gloss. The optical quality thereof is in no way decreased compared to the above-mentioned Ni layers with organic matting additives. Moreover, with the method according to the invention, the degree of brilliant or matte finish can be controlled easily and in a well adjustable manner by various galvanic parameters, especially by the time of treatment and/or the current. Further, there is no more necessity to filter the solutions for filtering-out organic matting additives.

The sulfamate Ni layer mentioned is advantageously protected from the environment by a further final layer wherein said final layer naturally may have a decoration function as well. Especially, a galvanic Cr layer is preferred which can have a thickness between 0.1 μm and 3 μm wherein a lower limit of 0.5 μm and an upper limit of 1 μm are more preferred, respectively. Here, a conventional bright-Cr process available by commercial solutions can be used because the satin finish of the surface is already present.

However, the invention is not restricted to Cr layers. Other decoration layers can be used as well, e. g. Ag, Au, or Pt metals. Considered are also black Cr layers, Ti layers, especially sputtered Ti layers, and non-metallic layers as (clear) lacquers or (sputtered) ceramic layers.

The smooth surface on the workpiece below the matte Ni layer can be a polished surface of the workpiece itself or a deposited metal layer. Using a bright Ni layer, which is preferred according to the invention, has the special advantage that surface flaws and defects can be planished very well. This layer thus can improve the quality of the brilliance which finally determines i.a. the gloss ratio of the finished metal surface of the invention. Galvanic processes for bright Ni layers are commonly known and need not to be explained in detail. Commercial solutions are available, that can comprise e.g. Ni sulphate, organic brilliance additives and so-called planishers. Adequate current densities herefore are between 1 and 3 $A/dm^2$. It can be a further advantage to provide a brilliant metal layer, e.g. a Cu layer, already below the bright Ni layer.

The matte galvanic Ni layer is advantageously deposited in the form of a Watt Ni layer known as such and technically controlled especially well, i.e. as a galvanic Ni layer without organic matting additives. Herein, a microscopically nodule-like layer structure is produced in which the nodule size and distance finally determining the degree of matte finish, can be adjusted by the current and/or the treatment time. A maximum degree of matte finish results from that the nodules lie practically adjacent to each other. Currents in the region of 0.1 $A/dm^2$ to 2 $A/dm^2$ are preferred, even more preferred are 0.1 $A/dm^2$ to 1 $A/dm^2$. The layer thickness of the matte layer should be comparatively low and can be between 0.05 μm and 5 μm wherein upper limits of 4 μm, 3 μm, 2 μm and most advantageously 1 μm as well lower limits of 0.075 μm and most advantageously 0.1 μm are even better. The layer thickness is determined according to optical/esthetical considerations.

The galvanic deposition of a sulfamate Ni layer is conventional and known as well. The corresponding solutions comprise Ni sulfamate, i. e. the salt of the sulfamic acid. The sulfamate Ni layer makes the above-mentioned nodule-like or otherwise matte Ni layer somewhat rounder and enforces it somewhat but does not really planish it. The sulfamate Ni layer increases especially the nodule size without fundamentally changing the granular structure named "nodule-like" above. Thus, it conserves the matte finish, possibly increases the degree of gloss in a minor amount, but primarily produces an increased material thickness desired for reasons of stability and wear resistance, and thus provides for improved properties of wiping sensitivity and of repelling contaminations. The roughness reduced by the rounding effect gives less hold or ground to contaminations. An appropriate thickness for the sulfamate Ni layer is in the region of 5 μm to 20 μm wherein a lower limit of 10 μm and an upper limit of 15 μm are more preferred. It has already been mentioned that a protective final layer is preferred. If the metallic Ni colour is of interest, a clear lacquer can also be used here.

A further advantage of the invention, besides the good optical properties and the good resistance and insensitivity against contaminations of surfaces according to the invention, is that the degree of bright finish or matte finish can be very easily adjusted by galvanic parameters. By one and the same basic process, i.e. unchanged solution compositions, identical baths etc., different optical properties can be produced. Especially the degree of matte finish can be adjusted simply from batch to batch by the current or, even more preferred, by the treatment time. The thicker the matte Ni layer is, the higher is the degree of matte finish.

BRIEF DESCRIPTION OF THE DRAWINGS

The invention will be explained in more details by means of an exemplary embodiment shown in the figures schematically.

DETAILED DESCRIPTION OF THE PREFERRED EMBODIMENT

Figure 1:
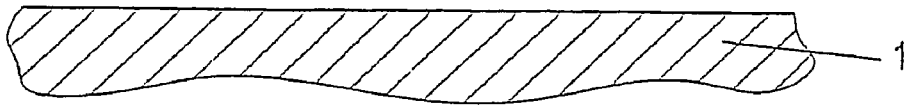
FIGS. 1-5 show different intermediate stages of a method according to the invention.
Figure 2:
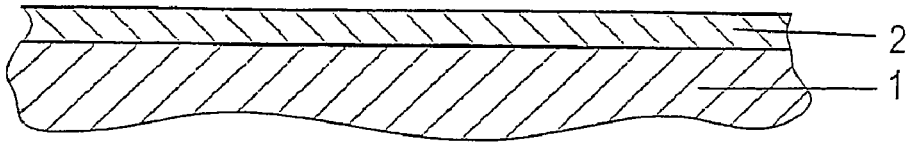

As the embodiment a door handle of a car made of plastic is metalised in a satin manner. FIG. 1 shows schematically a surface of the door handle 1. According to FIG. 2, a bright Ni layer 2 is deposited onto said surface in a manner known per se.

Hereto, the surface of the plastic door handle can be seeded in advance and prepared, e.g. by a chemically deposited thin metal layer, for the galvanic process.

The bright Ni layer 2 is deposited from an aqueous solution by a standard galvanic process at 2 A/dm$^2$, the solution comprising approximately 180 g/l Ni sulphate, approximately 150 g/l Ni chloride and approximately 50 g/l boric acid as a pH buffer as well as standard commercial organic brightness in enhancing additives common in bright-Ni baths. E.g., the bath Slotonik-50 of Schlötter can be used.

Bright Ni layer 2 has the function to provide for a bright basis as flawless as possible and is characterized by its good properties of planishing imperfections present at first. Its thickness is not really important for the succeeding method and depends on the one hand from the desired final material thickness, especially in view of wear-resistance, and on the other hand from the surface flaws to be planished. Typical ranges are in the region of 10-30 μm.

Figure 3:
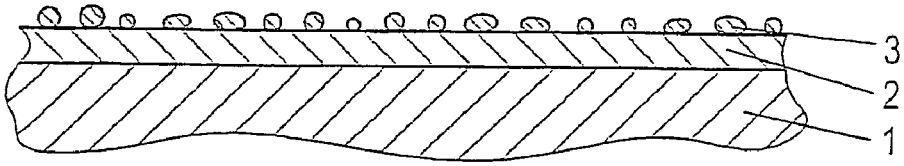

A matt Watt Ni layer 3 is deposited onto bright Ni layer 2 according to FIG. 3. This is done using a current density of approximately 0.5 A/dm$^2$ in an aqueous solution including 210 g/l Ni sulphate, 35 g/l Ni chloride and 40 g/l boric acid without further additives. The preferred thickness range is between 0.1 μm and 1 μm, wherein the thickness is used for adjusting the degree of matt finish of the finally resulting layer. In this embodiment 0.2 μm are deposited.

FIG. 3 shows that these layer thicknesses are meaningful only the sense of an average. Actually, the growth is very granular or nodule-like wherein the individual grains shown in FIG. 3 schematically increase in size with increasing average layer thickness and decreasing mean distances there between. In substantially larger thicknesses, the grains are finally dense or adjacent, thereby resulting in a matt layer that does not let through the brilliance of bright Ni layer 2 there below anymore.

Figure 4:
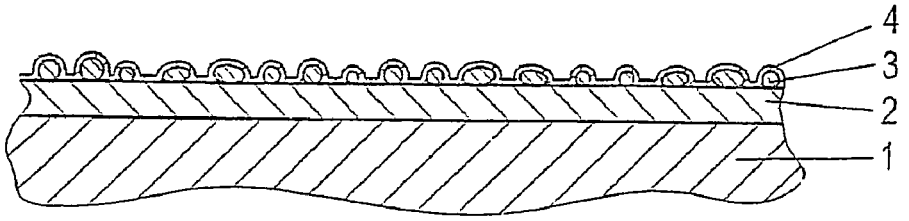

In the next step shown in FIG. 4, a sulfamate Ni layer 4 is deposited onto Watt Ni layer 3. The grains are enforced hereby, the edges are rounded somewhat, and especially the niches and corners at the border of the grains are filled.

Here, a 12 μm thick layer is deposited at a galvanic current density of 1 A/dm$^2$. The aqueous solution comprises 36 Vol.-% of 60 weight-% Ni sulfamate solution. The galvanic solution comprises 5 g/l Ni chloride and 35 g/l boric acid. The bath Schlötter MS can be used for example.

Figure 5:
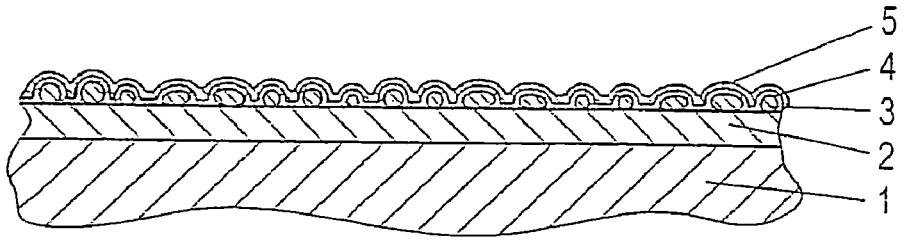

Finally, an optional final layer is deposited thereon as shown in FIG. 5. In this embodiment, a common bright Cr layer 5 of 1.5 μm thickness is used hereto. The Schlötter bath Slotochrom GC10 comprising Cr of oxidation no. 6 or Slotochrom 50 comprising Cr of oxidation no. 3 can be used.

Thus, the complete layer is well protected against the environment and oxidation resistant due to the properties of the Cr surface. It finally shows a metallic Cr gloss which is desired in this example. Due to the somewhat rounder-making properties of the sulfamate Ni layer, the contamination sensitivity and the roughness are substantially improved and well-adapted for applications in the inner compartment of an automobile.

If desired, other final layers and thus other colours can be used, naturally. These would not change the basic principle of producing a satin gloss by the cooperation of a brilliant metal layer, here the bright Ni layer, and a matt Ni layer of comparatively low thickness thereon.

Seen in total, the embodiment is a simple process giving control of the substantial layer properties by the treatment time, especially of the degree of matt finish of the resulting satin gloss by the time of the Watt Ni process. The above-mentioned disadvantages of organic matting additives do not apply anymore. Thus, the process is practical, well reproducible and cost-effective.

What is claimed is:

1. A method for producing a satin metal surface on a workpiece comprising the steps:

producing a smooth surface on said workpiece, depositing a matte Ni layer by galvanic deposition without organic matting additives on said smooth surface, thereafter galvanically depositing a sulfamate Ni layer on said workpiece, wherein said matte layer is deposited as a Watt Ni layer and a current density on said workpiece during said deposition of said Watt Ni layer is between 0.1 and 1 A/dm$^2$ and wherein said smooth surface on said workpiece is produced by galvanic deposition of a bright Ni layer.

2. The method of claim 1 wherein the current density on said workpiece during said galvanic deposition of said bright Ni layer is between 1 and 3 A/dm$^2$.

3. The method of claim 1, wherein said matte Ni layer has a thickness between 0.05 and 4 μm.

4. The method of claim 1, wherein the current density on said workpiece during said deposition of said sulfamate Ni layer is between 0.1 and 1 A/dm$^2$.

5. The method of claim 1, wherein said sulfamate Ni layer has a thickness between 5 and 20 μm.

6. The method of claim 1 adapted for producing satin metal surfaces on a plurality of workpieces and further comprising the steps of producing said metal surfaces to have a different degree of matte finish and adjusting said different degrees of matte finish by different thicknesses of said matte Ni layers.

7. The method of claim 6 wherein said respective thicknesses of said matte Ni layers are adjusted by the duration of said galvanic deposition.

8. A method for producing a satin metal surface on an automobile part located in an inner compartment of an automobile a comprising the steps:

producing a smooth surface on said automobile part, depositing a matte Ni layer by galvanic deposition without organic matting additives on said smooth surface, thereafter galvanically depositing a sulfamate Ni layer on said automobile part, wherein said matte layer is deposited as a Watt Ni layer and a current density on said automobile part during said deposition of said Watt Ni layer is between 0.1 and 1 $A/dm^2$ and wherein said smooth surface on said automobile part is produced by galvanic deposition of a bright Ni layer, and wherein said satin metal surface is a decoration surface of said automobile part.

* * * * *